US005287959A

United States Patent [19]

Hansen et al.

[11] Patent Number: 5,287,959

[45] Date of Patent: Feb. 22, 1994

[54] DOMED CONTAINER FOR BAKED GOODS OR THE LIKE

[75] Inventors: Darryl P. Hansen, Shortsville; Raj K. Mangla, Pittsford; Raul Matos, Rochester; Dennis Oberdorf, Canandaigua; Chris Olenski, Walworth, all of N.Y.

[73] Assignee: Mobil Oil Corporation, Fairfax, Va.

[21] Appl. No.: 56,641

[22] Filed: May 3, 1993

[51] Int. Cl.[5] ..... B65D 41/06

[52] U.S. Cl. ..... 206/45.32; 220/306; 220/671; 220/675

[58] Field of Search ..... 220/306, 355, 380, 671, 220/675, 293, 574; 206/45.32

[56] References Cited

U.S. PATENT DOCUMENTS

| | | | |
|---|---|---|---|
| 2,246,695 | 6/1941 | Phillips | 206/44 |
| 2,914,104 | 11/1959 | Jocelyn | 150/0.5 |
| 3,303,964 | 2/1967 | Luker | 220/675 X |
| 3,690,902 | 9/1972 | Dahl | 99/172 |
| 3,770,115 | 11/1973 | Cannell | 206/45.32 |
| 3,794,090 | 2/1974 | Commisso | 220/306 |
| 4,197,940 | 4/1980 | DeRossett | 220/306 X |
| 4,375,862 | 3/1983 | Kurinsky et al. | 220/306 X |
| 4,741,452 | 5/1988 | Holzkopf | 206/45.32 X |
| 4,863,058 | 9/1989 | Antoni et al. | 220/380 X |
| 4,874,083 | 10/1989 | Antoni et al. | 206/45.32 |

*Primary Examiner*—Steven M. Pollard

*Attorney, Agent, or Firm*—Alexander J. McKillop; George W. Hager, Jr.; Michael J. Mlotkowski

[57] ABSTRACT

A domed container. The container includes a receptacle and dome cover therefore having locking means for releasably locking the cover to the receptacle. The receptacle includes a bottom wall having a top surface delimited by an upstanding rib and terminating in an outwardly extending resilient rim. The dome cover includes a top wall having at least one wall depending therefrom, the depending wall having a plurality of vertical inwardly extending ribs spaced therealong, each of the vertical inwardly extending ribs having an upper end and a lower end, interspersed between the plurality of vertical inwardly extending ribs is a plurality of vertical outwardly extending ribs, each of the vertical outwardly extending ribs having an upper end and a lower end, each the upper end of the vertical outwardly extending ribs having a crush-resistant ribbed crown portion thereof, the depending wall having a lower end adapted to be received in the space formed between the upstanding rib and the rim of the receptacle, with the lower end of the inwardly extending vertical ribs of the dome relieved so as to avoid an abutting relation with the rib of the receptacle, the lower end of the depending wall terminating in an outwardly extending resilient flange adapted to underlie the shoulder in abutting locking engagement therewith.

20 Claims, 4 Drawing Sheets

DOMED CONTAINER FOR BAKED GOODS OR THE LIKE

FIELD OF THE INVENTION

The present invention relates to disposable containers having domed covers and, more particularly, to a relatively thin-walled, thermoformed domed container for packaging and displaying the food product placed within.

BACKGROUND OF THE INVENTION

In the retail merchandising of cakes, pastries and the like, it is a common practice to package such items in containers which protect the entire item from contamination. In the usual case, the baked good is placed on a plate or dish constructed of foil, paper or fiberboard and placed in a container, often a cardboard box.

It is well known that the overall appearance of a particular product often provides the motivation necessary for the consumer to purchase it. As is often the case in today's competitive marketplace, products fairly equivalent in quality find themselves positioned side-by-side on the retailer's shelf. If the appearance of the container is pleasing or the article itself is attractively displayed it can and, often does, induce the consumer to purchase the item so packaged.

Due to their pleasing appearance, as well as other desirable features, plastic containers have found increased acceptance in the marketplace. Such containers generally employ a cover formed from a transparent material to permit visual inspection of the packaged item of food. Since the economies of disposable packaging demand a lightweight material for the container, many containers do not offer the rigidity necessary to protect the article contained within. Moreover, standard means of closure are often difficult to provide in these applications, with stapling, tape and the like sometimes employed to overcome the shortcomings of certain container designs.

A large number of containers have been developed for the producers and distributors of food. For example, U.S. Pat. No. 2,246,695 discloses a container for cakes, pies and similar articles of food. The containers are formed with relation to the article of food for which they are to be used, providing a dish with reinforcing ribs for containing the article of food and a flexible, removable transparent cover.

U.S. Pat. No. 2,914,104 discloses a flexible container molded from a plastic material, such as polyethylene. The container comprises two container members adapted to be releasably joined together around an outer annular edge thereof in a substantially sealing relation.

U.S. Pat. No. 3,690,902 discloses a cake cover designed to be detachably secured to a corrugated cake base for packaging a cake therein. The cake cover includes a side wall consisting of a plurality of vertically extending small ribs and a plurality of vertically extending large ribs interspersed among the small ribs, both sets of ribs being spaced outwardly from an inner peripheral boundary defined by the intersection of adjacent ribs, and a relatively rigid dome portion designed to enclose a cake mounted on the corrugated cake base.

U.S. Pat. No. 3,770,115 discloses a packaging container for shipping and displaying pies consisting of a shockabsorbing base shell of concave form which receives and supports a pie pan in such a manner that shocks are not readily transmitted. A transparent convex cover is provided which snaps onto the base shell and grips the flange or rim of the pan. The base shell and the cover are complementarily formed so that the container assemblies can be stacked without the likelihood of being displaced laterally, the shell of one assembly resting on and interfitting with the cover of the assembly next below.

U.S. Pat. No. 4,741,452 discloses the combination of a domed cover for a container wherein the cover has an outwardly biased flange designed to flex inward to snap-lock disposition with an inwardly biased rim of the underlying container, and a skirt portion formed intermediate the flange and the walls of the cover.

U.S. Pat. No. 4,863,058 discloses a food packaging cover for use with a compatible tray. The cover includes a top section, a wall section, a shoulder section interconnecting the top section and the wall section and a bottom peripheral edge formation designed to lockably engage the tray. The wall section is formed from a repeating pattern of furrows which enhance the strength of the cover. The interconnecting shoulder section is formed from triangular flats interspaced by gusset members to effect substantial uniform distribution to the wall section of a load placed on the top section.

While the aforementioned containers generally meet the requirements for which they were designed, a need still exists for a container which provides the strength and rigidity necessary to protect a baked good or other article placed therein, while also providing a closure means which is both secure and easy to use.

SUMMARY OF THE INVENTION

In accordance with the present invention, there is provided a domed container. The container includes a receptacle and a dome cover therefore having locking means for releasably locking the cover to the receptacle. The receptacle includes a bottom wall having a top surface delimited by an upstanding rib and terminating in an outwardly extending resilient rim wherein the rim is outwardly yieldable, the bottom wall having a bottom surface including depending rib structure extending below the bottom of the rim wherein the rim is downwardly yieldable, the rim encompassing in spaced relation the rib and being provided with an inwardly extending shoulder, and a first camming surface formed on the rim and extending outwardly and upwardly from the shoulder. The dome cover includes a top wall having at least one wall depending therefrom, the depending wall having a plurality of vertical inwardly extending ribs spaced therealong, each of the vertical inwardly extending ribs having an upper end and a lower end, interspersed between the plurality of vertical inwardly extending ribs is a plurality of vertical outwardly extending ribs, each of the vertical outwardly extending ribs having an upper end and a lower end, each the upper end of the vertical outwardly extending ribs having a crush-resistant ribbed crown portion thereof, the depending wall having a lower end adapted to be received in the space formed between the upstanding rib and the rim of the receptacle, with the lower end of the inwardly extending vertical ribs of the dome relieved so as to avoid an abutting relation with the rib of the receptacle, the lower end of the depending wall terminating in an outwardly extending resilient flange adapted to underlie the shoulder in abutting locking engagement therewith preventing movement of the dome cover relative to the receptacle, and a second camming surface formed on the exterior of the flange. In use, when the cover is moved towards the container to effect locking engagement therewith, the first and second camming surfaces initially coacting with one another causing the rim to be deformed outwardly and downwardly and the flange to be deformed inwardly towards the lower end of the depending wall while the latter is substantially reinforced by a portion of the rib of the receptacle until the flange abuttingly engages the underside of the shoulder.

Therefore, it is an object of the present invention to provide a disposable domed container, having locking means therefore, in which the contents of the container are capable of being pleasingly displayed.

It is another object of the present invention to provide such a domed container which is easy to manufacture and is reasonably rigid and durable.

It is a further object of the present invention to provide a domed container which is capable of being opened and closed a plurality of times without the failure of its component parts.

Other objects and the several advantages of the present invention will become apparent to those skilled in the art upon a reading of the specification and the claims appended thereto.

BRIEF DESCRIPTION OF THE DRAWINGS

The actual construction, configuration and advantages of the present invention will be better understood by referring to the following drawings in which like numerals identify like elements and in which.

DETAILED DESCRIPTION OF THE INVENTION

Figure 1:
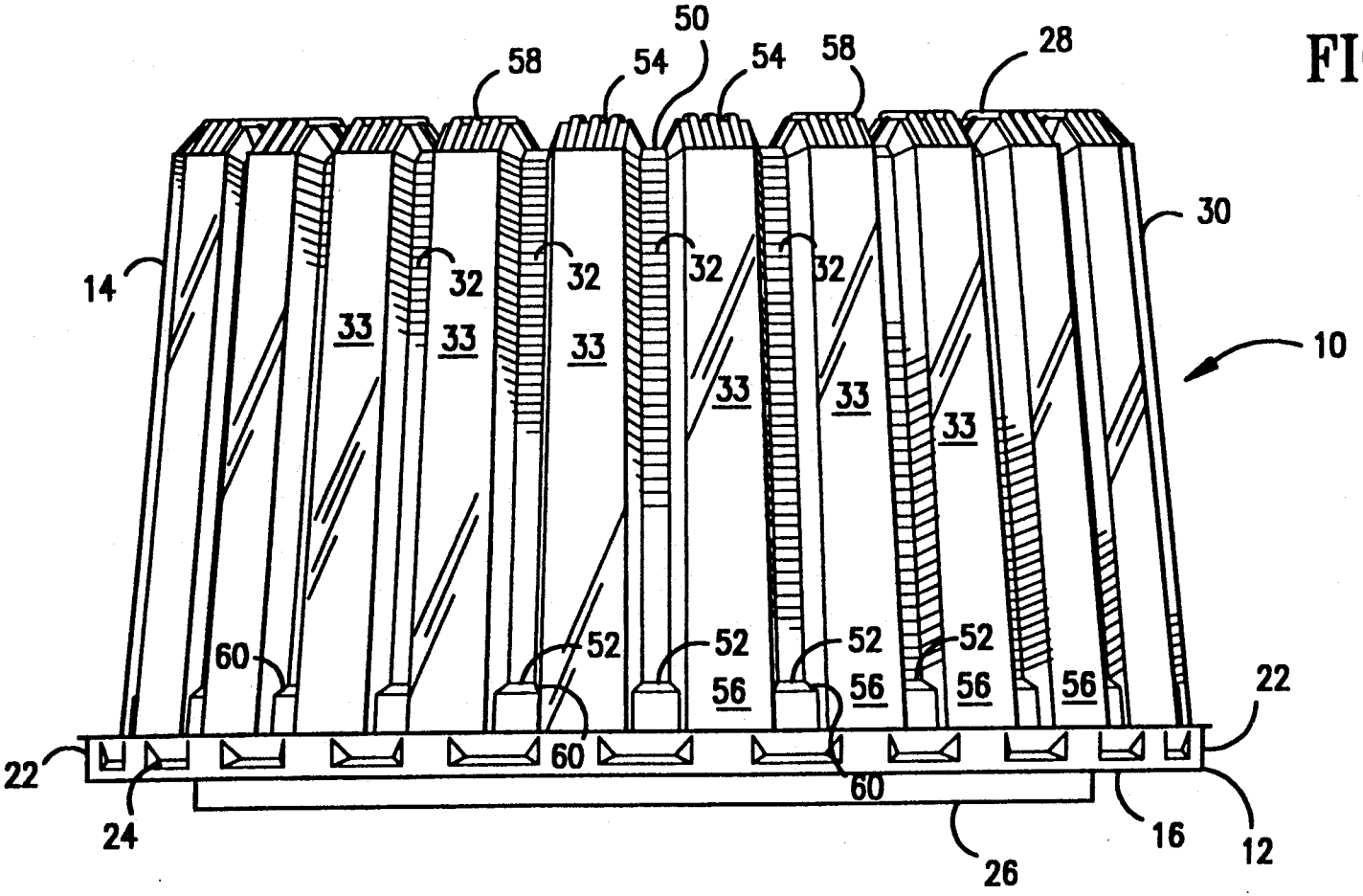
FIG. 1 is a side view of a preferred embodiment of a domed container for packaging and displaying a food product.
Figure 4:
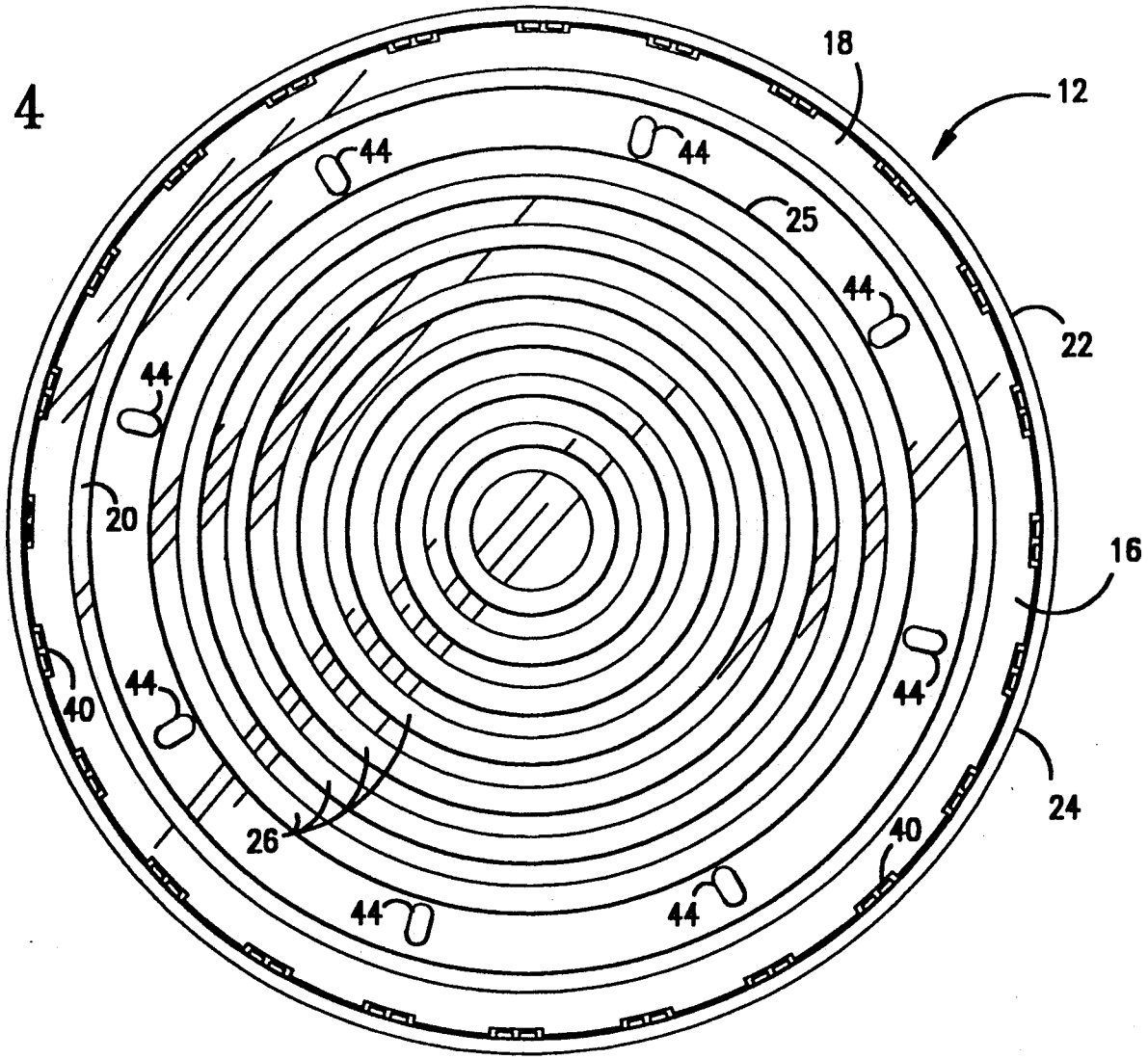
FIG. 4 is a top view of the receptacle of the FIG. 1 embodiment of a domed container.

The present invention is best understood by reference to the appended figures, which are given by way of example and not of limitation. Referring now to FIG. 1, a side view of a preferred embodiment of a domed container 10 for packaging and displaying a food product is shown in a closed condition. The food container 10 includes a receptacle 12 and a dome cover 14. Referring also to FIG. 4, in which a top view of the receptacle 12 of FIG. 1 is presented, receptacle 12 is shown to include a bottom wall 16 having a top surface 18 delimited by an upstanding circumferential rib 20 and terminating in an outwardly extending resilient rim 22. As will be described hereinbelow, outwardly extending resilient rim 22 is capable of yielding outwardly when dome cover 14 is being installed. Bottom wall 16 of receptacle 12 has a bottom surface 24 which includes depending rib structure 26 extending below the bottom of the rim 22. As will also be explained hereinbelow, the location and configuration of upstanding rib 20 permits rim 22 to also be downwardly yieldable.

Figure 3:
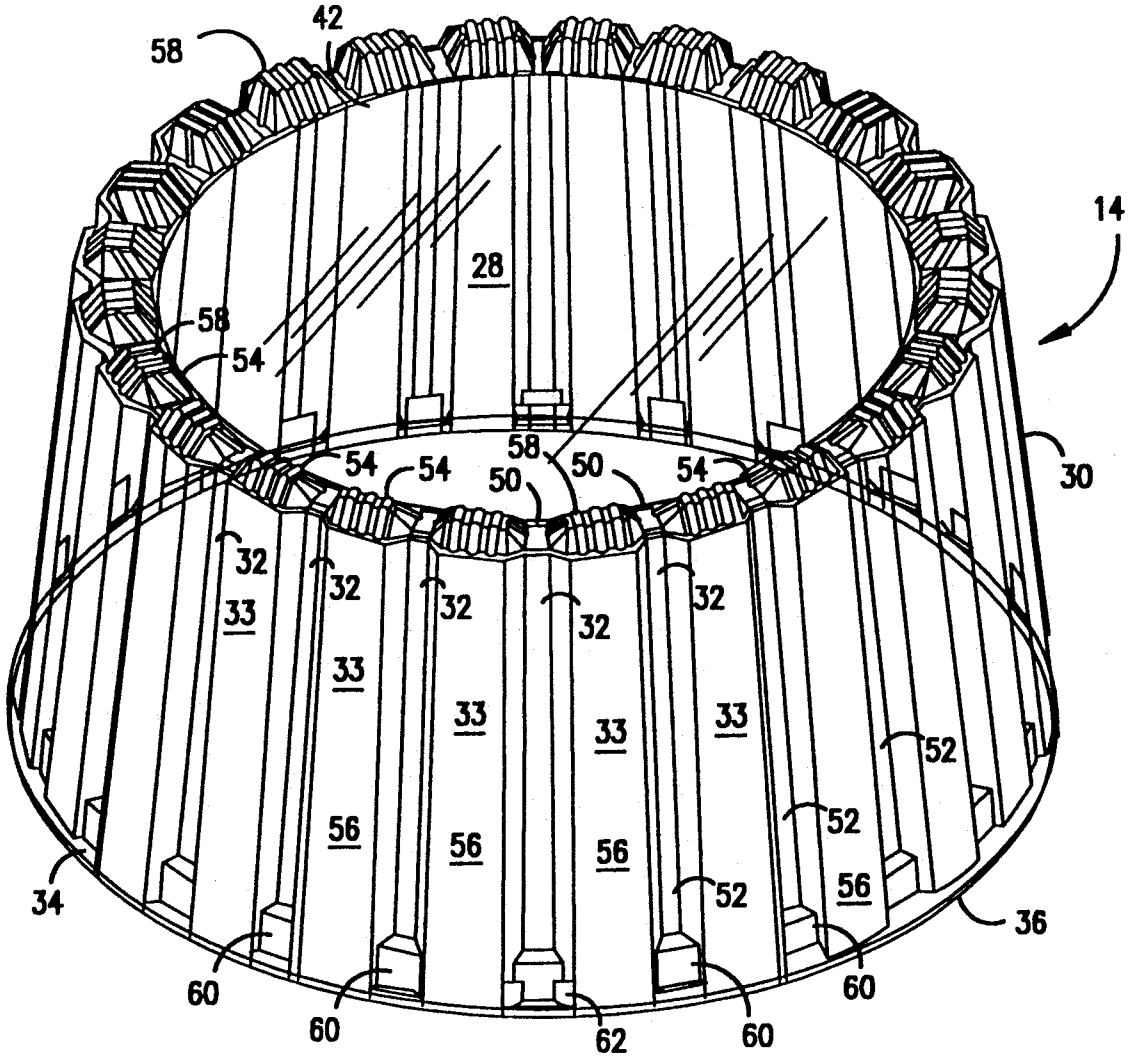
FIG. 3 is a perspective view of the cover of the FIG. 1 embodiment of a domed container.

Referring again to FIG. 1, it may be seen that dome cover 14 includes a top wall 28 having at least one wall 30 which depends therefrom. Depending wall 30 is shown to have, as is particularly preferred, a plurality of vertical inwardly extending ribs 32 spaced therealong, each vertical inwardly extending rib 32 having an upper end 50 and a lower end 52. Interspersed between the plurality of vertical inwardly extending ribs 32 is a plurality of vertical outwardly extending ribs 33, each of the vertical outwardly extending ribs 33 having an upper end 54 and a lower end 56. As may be seen, each upper end 54 of the vertical outwardly extending ribs 33 has a crush-resistant ribbed crown portion 58. Referring also to FIG. 3, wherein a perspective view of dome cover 14 is shown, it may be seen that depending wall 30 also has a lower end 34 adapted to be received in the space formed between rib 20 and rim 22 of receptacle 12. Lower end 34 of depending wall 30 terminates in an outwardly extending resilient flange 36.

Figure 2:
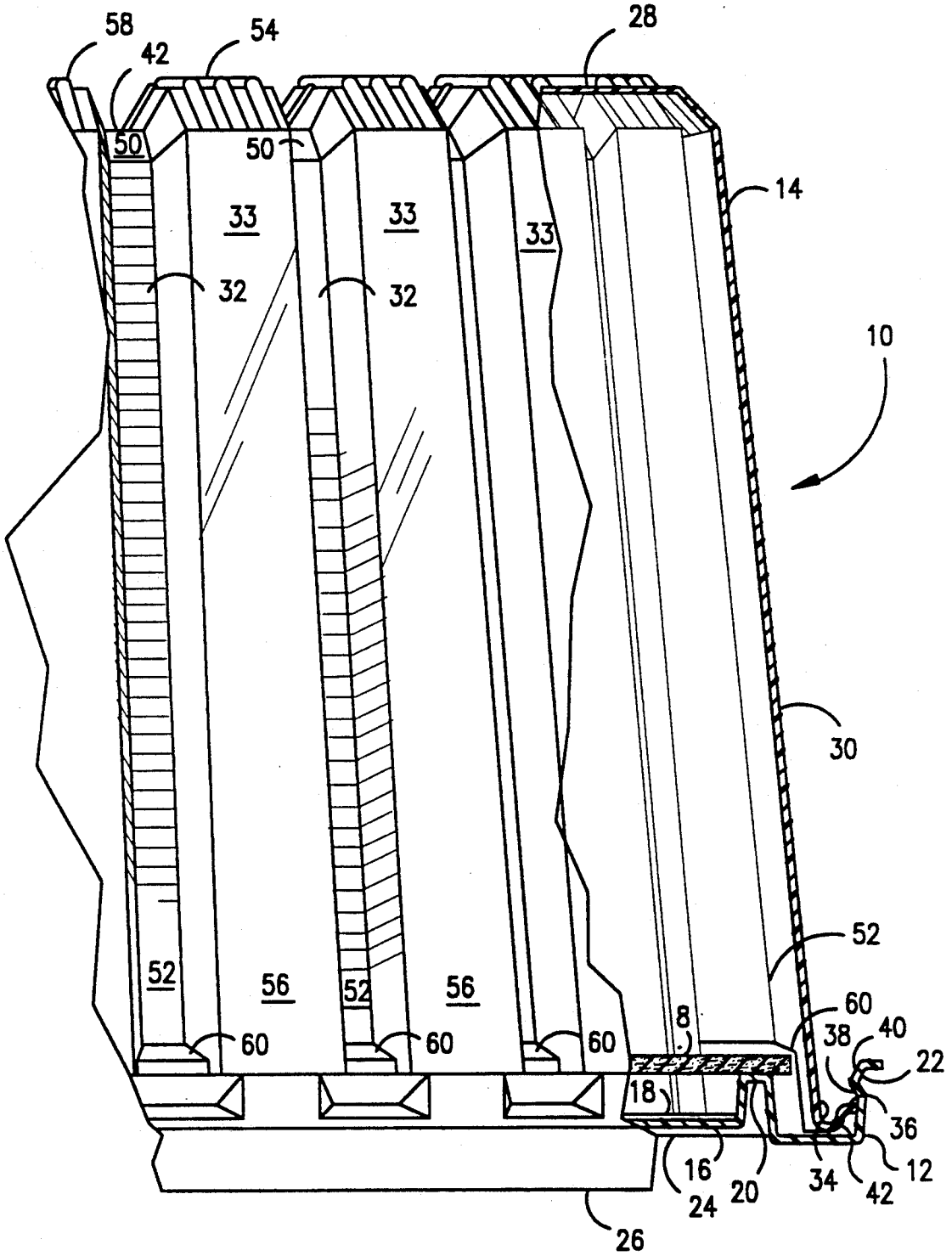
FIG. 2 is an enlarged, fragmentary view, in partial cross-section, of the FIG. 1 embodiment showing in detail a preferred container closure means.

Referring now to FIG. 2, an enlarged, fragmentary view, of the FIG. 1 embodiment is depicted in partial cross-section in order to show the locking means particularly preferred in the practice of the present invention. As may be seen, rim 22 encompasses, in spaced relation, upstanding rib 20 and is provided with an inwardly extending shoulder 38, and a first camming surface 40 formed on rim 22 and extending outwardly and upwardly from shoulder 38. Outwardly extending resilient flange 36 of lower end 34 of dome cover 14 is adapted to underlie shoulder 38 in abutting locking engagement therewith, thus preventing movement of dome cover 14 relative to receptacle 12. Outwardly extending resilient flange 36 also includes a second camming surface 42 formed on the exterior of flange 36. As may also be seen, when container 10 is in the closed condition, with a cake board B placed therein, upstanding rib 20 advantageously provides support for cake board B. Moreover, as is preferred, each lower end 52 of inwardly extending vertical rib 32 is provided with a relieved region 60, so as to avoid an abutting relationship with rib 20 of receptacle 12 when the container 10 is in the closed condition. Such an abutting relationship, as those skilled in the art would plainly recognize, would necessitate the use of a cake board B of smaller diameter.

In use, when seeking to close the domed container of the present invention, as dome cover 14 is moved towards receptacle 12 in order to effect a locking engagement therewith, the first camming surface 40 of receptacle 12 and the second camming surface 42 of dome cover 14 initially co-act with one another causing rim 22 deformed outwardly and downwardly, with the outwardly extending flange 36 to be deformed inwardly towards lower end 34 of depending wall 30, while the latter is substantially reinforced by a portion of rib 20 of receptacle 12 until flange 36 abuttingly engages the underside of the shoulder 38. The novel and preferred locking means of the present invention provides a secure locking feature without the exertion of high localized stresses on the relatively thin-walled dome cover or receptacle during container closure.

Reference is made once again to FIG. 3. As may be appreciated by those skilled in the art, cover 14 is strengthened by the provision of a plurality of vertical inwardly extending ribs 32 and a plurality of vertical outwardly extending ribs 33. Also provided is a stacking recess 42 formed in top wall 28 by the uppermost portions of top wall 28, adjacent the plurality of vertical outwardly extending ribs 33. As may be appreciated seen, the plurality of vertical inwardly extending ribs 32, particularly preferred from the standpoint of cover strength, also contribute to the overall pleasing appearance of container 10. Stacking recess 42 of top wall 28, as can be readily visualized, is configured to permit a bottom wall 24 of another receptacle 12 to nest therein in stacking relation. Also provided are a plurality of stacking lugs 62, each located at the lower portion 52 of vertical inwardly extending rib 32. As may be appreciated by those skilled in the art, the provision of stacking lugs 62 facilitates the easy de-nesting of one dome cover 14 from another dome cover 14. Although two, three, four or more stacking lugs 62 may be located about the lower portion of dome cover 14, as may be appreciated, the number of stacking lugs 62 to be provided will very from application to application.

Still referring to FIG. 3, the particularly pleasing appearance achieved through the use of the trapezoidal-shaped vertical inwardly extending ribs 32 depicted is readily apparent. However, as may be appreciated, a variety of shapes of same is clearly acceptable and within the scope of the present invention. Such shapes include cylindrical, rectangular and the like.

Reference is made once again to FIG. 4, wherein a top view of receptacle 12 of a preferred embodiment of container 10 is presented. Consistent with the preferred configuration of cover 14, strength is imparted to receptacle 12 by the provision of the depending rib structure 25 of bottom wall 16 of receptacle 12 which extends below the bottom of the rim 22. As is preferred in the practice of the present invention, depending rib structure 25 of receptacle 12 includes a plurality of radially disposed substantially concentric ribs 26. As shown and, as is particularly preferred, the radially disposed concentric ribs 26 are substantially rectangular in cross-section. Additionally, a plurality of raised support means 44 are provided about the upper surface of receptacle 12 in order to support a cake board or similar article. Such a configuration provides for the ready acceptance of the standard cake plates used in the baking industry. Moreover, as can be appreciated, support ribs 44, together with depending rib structure 26, also contribute to strengthening the overall structure, aiding in reducing the gauge thickness of receptacle 12.

As can be appreciated, it is within the scope of the present invention to modify the shape of receptacle 12 to accommodate any of a number of foods which would benefit from the use of inventive concept disclosed herein. Modification to cover 14 to achieve the same purpose is also within the scope of the present invention, as those skilled in the art would readily recognize.

Referring again to FIG. 1, it is presently preferred that domed container 10 be made of a thin gauge synthetic thermoplastic such as biaxially oriented transparent polystyrene (OPS), amorphous polyethylene terephthalate (APET), crystalline polyethylene terephthalate (CPET) and talc-filled polypropylene. When the preferred thermoplastic materials are employed, a gauge thickness on the order of about 8 to about 14 mils is known to provide suitable performance. As those skilled in the art recognize, other clear or opaque plastics having the requisite strength and ease of processing may also be employed. The preferred range of gauge thickness may be utilized in view of the strength imparted by the provision of the depending rib structure 26 of bottom wall 16 of receptacle 12 and other features hereinabove mentioned. Likewise, cover 14 has strength imparted to its overall structure by the provision of the plurality of vertical inwardly extending ribs 32, permitting the preferred range of gauge thickness to be effective.

It is to be understood that the containers of the present invention may assume a wide variety of shapes as necessitated by the particular application to be practiced.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A domed container comprising a receptacle and a dome cover therefore having locking means for releasably locking the cover to the receptacle, said receptacle comprising a bottom wall having a top surface delimited by an upstanding rib and terminating in an outwardly extending resilient rim wherein said rim is outwardly yieldable, said bottom wall having a bottom surface including depending rib structure extending below the bottom of said rim wherein said rim is downwardly yieldable, said rim encompassing in spaced relation said rib and being provided with an inwardly extending shoulder, and a first camming surface formed on said rim and extending outwardly and upwardly from said shoulder; and said dome cover comprising a top wall having at least one wall depending therefrom, said depending wall having a plurality of vertical inwardly extending ribs spaced therealong, each of said vertical inwardly extending ribs having an upper end and a lower end, interspersed between said plurality of vertical inwardly extending ribs is a plurality of vertical outwardly extending ribs, each of said vertical outwardly extending ribs having an upper end and a lower end, each said upper end of said vertical outwardly extending ribs having a crush-resistant ribbed crown portion thereof, said depending wall having a lower end adapted to be received in the space formed between said upstanding rib and said rim of said receptacle, with said lower end of said inwardly extending vertical ribs of said dome relieved so as to avoid an abutting relation with said rib of said receptacle, said lower end of said depending wall terminating in an outwardly extending resilient flange adapted to underlie said shoulder in abutting locking engagement therewith preventing movement of said dome cover relative to said receptacle, and a second camming surface formed on the exterior of said flange;

when said cover is moved towards said container to effect locking engagement therewith, said first and second camming surfaces initially co-acting with one another causing said rim to be deformed outwardly and downwardly and said flange to be deformed inwardly towards said lower end of said depending wall while the latter is substantially reinforced by a portion of said rib of said receptacle until said flange abuttingly engages the underside of said shoulder.

2. The domed container of claim 1, wherein said depending rib structure of said receptacle comprises a plurality of radially disposed substantially concentric ribs.

3. The domed container of claim 2, wherein said plurality of radially disposed concentric ribs are substantially rectangular in cross-section.

4. The domed container of claim 2, wherein said receptacle includes a plurality of said inwardly extending shoulders spaced around said rim of said receptacle.

5. The domed container of claim 4, wherein said plurality of vertical inwardly extending ribs on said dome corresponds to said plurality of inwardly extending shoulders on said rim on said receptacle.

6. The domed container of claim 5, wherein the spacing between said vertical inwardly extending ribs on said dome corresponds to the length of said ribs on said rim of said receptacle.

7. The domed container of claim 6, wherein said cover is manufactured by thermoforming a sheet of thermoplastic material.

8. The domed container of claim 7, wherein said sheet of thermoplastic material is selected from the group consisting of biaxially oriented polystyrene, amorphous polyethylene terephthalate, crystalline polyethylene terephthalate and talc-filled polypropylene.

9. The domed container of claim 8, wherein said sheet of thermoplastic material is transparent.

10. The domed container of claim 9, wherein said sheet of thermoplastic material has a gauge thickness of from about 8 mils to about 14 mils.

11. The domed container of claim 1, wherein said receptacle includes a plurality of said inwardly extending shoulders spaced around said rim of said receptacle.

12. The domed container of claim 11, wherein said plurality of vertical inwardly extending ribs on said dome corresponds to said plurality of inwardly extending shoulders on said rim on said receptacle.

13. The domed container of claim 11, wherein the spacing between said vertical ribs on said dome corresponds to the length of said ribs on said rim of said receptacle.

14. The domed container of claim 12, wherein the spacing between said vertical inwardly extending ribs on said dome corresponds to the length of said ribs on said rim of said receptacle.

15. The domed container of claim 1, wherein said receptacle is manufactured by thermoforming a sheet of thermoplastic material.

16. The domed container of claim 15, wherein said sheet of thermoplastic material is selected from the group consisting of biaxially oriented polystyrene, amorphous polyethylene terephthalate, crystalline polyethlene terephthalate and talc-filled polypropylene.

17. The domed container of claim 15, wherein said sheet of thermoplastic material has a gauge thickness of from about 8 mils to about 14 mils.

18. The domed container of claim 17, wherein said sheet of thermoplastic material is transparent.

19. The domed container of claim 1, wherein said receptacle further comprises a plurality of inwardly projecting support ribs to space a plate away from said bottom wall.

20. The domed container of claim 1, wherein said cover further comprises a stacking recess located on an upper surface of said top wall of said cover to permit a bottom wall of another receptacle to nest therein in a stacked relation.

* * * * *